US009500992B2

(12) United States Patent
Yoshida et al.

(10) Patent No.: US 9,500,992 B2
(45) Date of Patent: Nov. 22, 2016

(54) DEVELOPING DEVICE HAVING A POWDER CONVEYOR, PROCESS CARTRIDGE, AND IMAGE FORMING APPARATUS INCLUDING THE SAME

(71) Applicants: Tomofumi Yoshida, Ikeda (JP); Takafumi Miyazaki, Osaka (JP); Rie Mitani, Takarazuka (JP); Yasuhide Ohkubo, Toyonaka (JP); Yuusuke Furuichi, Ikeda (JP)

(72) Inventors: Tomofumi Yoshida, Ikeda (JP); Takafumi Miyazaki, Osaka (JP); Rie Mitani, Takarazuka (JP); Yasuhide Ohkubo, Toyonaka (JP); Yuusuke Furuichi, Ikeda (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/675,204

(22) Filed: Mar. 31, 2015

(65) Prior Publication Data

US 2015/0286163 A1 Oct. 8, 2015

(30) Foreign Application Priority Data

Apr. 7, 2014 (JP) ..... 2014-078763

(51) Int. Cl.
*G03G 15/08* (2006.01)

(52) U.S. Cl.
CPC ..... *G03G 15/0891* (2013.01)

(58) Field of Classification Search
CPC ..... G03G 2215/0816; G03G 2215/0827; G03G 2215/083; G03G 2215/0833
USPC ..... 399/254, 256
See application file for complete search history.

(56) References Cited

U.S. PATENT DOCUMENTS

| | | | |
|---|---|---|---|
| 4,026,241 | A * | 5/1977 | Takebe |
| 8,135,313 | B2 | 3/2012 | Yoshida et al. |
| 8,417,142 | B2 | 4/2013 | Furuichi et al. |
| 8,913,926 | B2 | 12/2014 | Nakamura et al. |
| 8,942,590 | B2 | 1/2015 | Furuichi |
| 2009/0162772 | A1 | 6/2009 | Fuwa et al. |
| 2011/0194863 | A1* | 8/2011 | Matsumoto |
| 2013/0236217 | A1 | 9/2013 | Nagatomo et al. |
| 2014/0153958 | A1 | 6/2014 | Ogata et al. |

FOREIGN PATENT DOCUMENTS

| | | |
|---|---|---|
| JP | 2012-037819 | 2/2012 |
| JP | 2012-159630 | 8/2012 |

OTHER PUBLICATIONS

Tomofumi Yoshida, et al., "Developing Device, Process Cartridge, and Image Forming Apparatus", U.S. Appl. No. 14/512,751, filed Oct. 13, 2014.

* cited by examiner

*Primary Examiner* — Walter L Lindsay, Jr.
*Assistant Examiner* — Milton Gonzalez
(74) *Attorney, Agent, or Firm* — Oblon, McClelland, Maier & Neustadt, L.L.P.

(57) ABSTRACT

A developing device includes a housing to store a powder, a developing roller to hold the powder, a supplying roller to supply the powder to the developing roller, a regulator to regulate the powder held by the developing roller, a powder conveyer to convey the powder for image forming, a first powder storing chamber, and a second powder storing chamber. The powder conveyor includes a first conveying part that includes a rotating axis, and a conveying surface inclined with respect to the rotating axis along a direction of the rotating axis. The powder conveyor further includes a second conveying part that includes a conveying surface parallel to the rotating axis along the direction of the rotating axis, and the first conveying part and the second conveying part are disposed alternately along the direction of the rotating axis.

12 Claims, 9 Drawing Sheets

DEVELOPING DEVICE HAVING A POWDER CONVEYOR, PROCESS CARTRIDGE, AND IMAGE FORMING APPARATUS INCLUDING THE SAME

CROSS-REFERENCE TO RELATED APPLICATION

This patent application is based on and claims priority pursuant to 35 U.S.C. §119(a) to Japanese Patent Application No. 2014-078763, filed on Apr. 7, 2014, in the Japan Patent Office, the entire disclosure of which is hereby incorporated by reference herein.

BACKGROUND

I. Technical Field

The present disclosure relates to a powder conveying member for use in an image forming apparatus such as a copier, printer, and facsimile machine; and a powder conveying device, a process cartridge, and an image forming apparatus using the developing device.

II. Description of the Related Art

An image forming apparatus, such as a copier, printer, facsimile machine, and combined machine thereof, generally includes a powder conveyer to covey a powder, such as toner, to develop a latent image. A conveying screw which has a shaft and a spiral vane, and a conveying paddle which has a plate around a shaft are known as a powder conveyer.

SUMMARY

In accordance with some embodiments of the present invention, a powder conveyer is provided.

The powder conveyer includes a first conveying part, and a second conveying part. The first conveying part includes a rotating axis, and a conveying surface inclined with the rotating axis along a direction of the rotating axis. The second conveying part includes a conveying surface parallel to the rotating axis along the direction of the rotating axis. The first conveying part and the second conveying part are disposed alternately along the direction of the rotating axis.

In accordance with some embodiments of the present invention, a conveying device is provided. The powder conveying device includes a driver to drive the powder conveyer, a housing, and the above-described powder conveyer.

In accordance with some embodiments of the present invention, a developing device is provided. The developing device includes a housing, a developing roller, a supplying roller, a regulator, and a developer conveyer that includes the above-described powder conveyer.

In accordance with some embodiments of the present invention, a process unit is provided. The process unit includes a photoreceptor, and the above-described developing device.

In accordance with some embodiments of the present invention, an image forming apparatus is provided. The image forming apparatus includes the above-described powder conveyer.

BRIEF DESCRIPTION OF THE DRAWINGS

A more complete appreciation of the disclosure and many of the attendant advantages thereof will be readily obtained as the same becomes better understood by reference to the following detailed description, when considered in connection with the accompanying drawings, in which.

DETAILED DESCRIPTION

Figure 1:
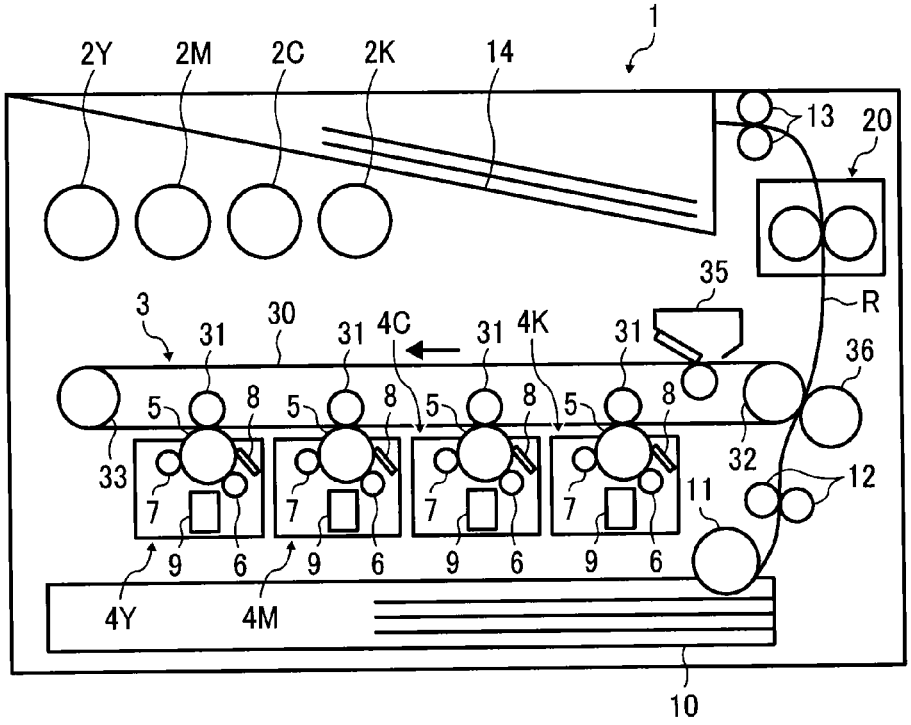
FIG. 1 is a schematic view of an image forming apparatus according to an embodiment of the present invention.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

For the sake of simplicity, the same reference number will be given to identical constituent elements such as parts and materials having the same functions and redundant descriptions thereof omitted unless otherwise stated.

An image forming apparatus according to an embodiment of the present invention is described below with reference to FIG. 1. An image forming apparatus 1 illustrated in FIG. 1 is a color laser printer. An intermediate transfer belt 30 is disposed approximately at a center part of the printer in a height direction. Four process cartridges 4Y, 4M, 4C, and 4K are disposed below the intermediate transfer belt 30. The process cartridges 4Y, 4M, 4C, and 4K have the same configuration except for storing developers with different colors of yellow (Y), magenta (M), cyan (C), and black (K), respectively, corresponding to the color separation components of a color image. Descriptions of the present embodiment are made with a case in which a one-component developer consisting of only toner is used, however, a two-component developer consisting of toner and carrier may also be used.

The toner may be a pulverized toner or polymerized toner. An external additive for toner may include silicone with silicone oil.

The external additive is obtained in a manner that the pulverized toner or the polymerized toner (100 parts by mass) is added to hydrophobic silica RY50 (2 parts by mass) (product of Nippon Aerosil Co., Ltd), and mixed together by a 20 L HENSCHEL MIXER (rotating speed 40 m/s for 5 minutes). Then the resultant mixture is caused to pass through a sieve with an opening size of 75 μm to remove coarse particles and aggregates.

Each of the process cartridges 4Y, 4M, 4C, and 4K includes a photoreceptor 5 in a drum-like shape serving as a latent image carrier, a charger 6 to charge a surface of the photoreceptor 5, a developing device 7 to supply toner to a surface of the photoreceptor 5, a cleaner 8 to clean a surface of the photoreceptor 5, and an irradiator 9 to irradiate a surface of the photoreceptor 5. In the present embodiment, an LED unit is employed as the irradiator 9.

A transfer device 3 is disposed above the process cartridges 4Y, 4M, 4C, and 4K. The transfer device 3 includes the intermediate transfer belt 30 serving as an intermediate transfer medium, four primary transfer rollers 31 serving as primary transfer means, a secondary transfer roller 36 serving as secondary transfer means, a secondary transfer backup roller 32, and a belt cleaner 35.

The intermediate transfer belt 30 is in the form of an endless belt and stretched taut with the secondary transfer backup roller 32 and a roller 33. The intermediate transfer belt 30 rotates in a direction indicated by an arrow in FIG. 1 as the secondary transfer backup roller 32 is driven to rotate.

Each of the four primary transfer rollers 31 and the corresponding photoreceptor 5 sandwich the intermediate transfer belt 30 to form a primary transfer nip. Each of the primary transfer rollers 31 is connected to a power source which applies a predetermined direct current voltage (DC) and/or an alternating current voltage (AC) thereto.

The secondary transfer roller 36 and the secondary transfer backup roller 32 sandwich the intermediate transfer belt 30 to form a secondary transfer nip. The secondary transfer roller 36 is connected to a power source which applies a predetermined direct current voltage (DC) and/or an alternating current voltage (AC) thereto.

The belt cleaner 35 includes a cleaning brush and a cleaning blade both disposed in contact with the intermediate transfer belt 30. The belt cleaner 35 is connected to a waste toner container with a waste toner transport hose.

Four toner cartridges 2Y, 2M, 2C, and 2K to store supplementary fresh toner are detachably mounted to an upper part of the printer. A supply path is provided between each of the toner cartridges 2Y, 2M, 2C, and 2K and each of the developing devices 7 to supply fresh toner from each of the toner cartridges 2Y, 2M, 2C, and 2K to each of the developing devices 7.

The toner is supplied to process units 4Y, 4M, 4C, 4K from toner cartridges 2Y, 2M, 2C, 2K as toner supplying units. The frequency of changing each process unit is thus reduced, which leads to a long life of the process unit and a reduced print unit price.

At a lower part of the main body of the printer, a paper feed tray 10 to store paper sheets, serving as recording media, and a paper feed roller 11 to feed the paper sheets from the paper feed tray 10, are provided. Other than normal paper sheets, sheets of thick paper, thin paper, coated paper, art paper, or tracing paper, postcards, envelopes, OHP sheets, etc., can be used as the recording media. It is possible to further provide a manual paper feed mechanism.

Inside the main body of the printer, a conveyance path R is provided to convey a paper sheet from the paper feed tray 10 to an outside of the printer via the secondary transfer nip.

On the conveyance path R, a pair of registration rollers 12 is provided upstream from the secondary transfer roller 36 relative to the direction of conveyance of the paper sheet. The pair of registration rollers 12 conveys the paper sheet to the secondary transfer nip at a right timing.

A fixing device 20 to fix an unfixed toner image on a paper sheet is provided downstream from the secondary transfer roller 36 relative to the direction of conveyance of the paper sheet. A pair of discharge rollers 13 to discharge the paper sheet to the outside of the printer is provided on the conveyance path R downstream from the fixing device 20 relative to the direction of conveyance of the paper sheet. On an upper surface of the main body of the printer, a discharge tray 14 is provided to stack paper sheets discharged from the printer.

Basic operation of this printer is explained below with reference to FIG. 1. At the beginning of an imaging operation, each of the photoreceptors 5 in the process cartridges 4Y, 4M, 4C, or 4K is driven to rotate clockwise in FIG. 1 by a driving device.

A surface of each of the photoreceptors 5 is then uniformly charged to a predetermined polarity by each of the chargers 6. The charged surface of the photoreceptor 5 is irradiated with laser light emitted from the irradiator 9 so that an electrostatic latent image is formed on the surface of the photoreceptor 5.

The laser light contains single-color image information of yellow, magenta, cyan, or black that is separated from full-color image information. The electrostatic latent image formed on each of the photoreceptors 5 is supplied with toner from each of the developing devices 7 and developed into a toner image that is visible.

On the other hand, the secondary transfer backup roller 32 is driven to rotate counterclockwise in FIG. 1 so that the intermediate transfer belt 30 is driven to rotate in the direction indicated by the arrow in FIG. 1. Each of the primary transfer rollers 31 is applied with a constant-voltage-controlled or constant-current-controlled voltage having an opposite polarity to that of the toner so that a transfer electric field is formed in the primary transfer nip defined between each of the primary transfer rollers 31 and each of the photoreceptors 5.

Upon reaching the primary transfer nips as the photoreceptors 5 rotate, the toner images on the respective photoreceptors 5 are sequentially transferred onto the intermediate transfer belt 30 and superimposed on one another by action of the transfer electric fields formed in the primary transfer nips. Thus, a full-color composite toner image is formed on a surface of the intermediate transfer belt 30.

Residual toner particles remaining on the photoreceptors 5 without being transferred onto the intermediate transfer belt 30 are removed by the cleaners 8. The surface of each of the photoreceptors 5 is neutralized by a neutralizer to initialize the surface potential.

At a lower part of the printer, the paper feed roller 11 starts rotating to feed a paper sheet from the paper feed tray 10 to the conveyance path R. The conveyance of the paper sheet is once stopped by the pair of registration rollers 12.

The pair of registration rollers 12 starts rotating at a predetermined timing so that the paper sheet is conveyed to the secondary transfer nip in synchronization with an entry of the full-color composite toner image on the intermediate transfer belt 30 into the secondary transfer nip. The secondary transfer roller 36 is applied with a transfer voltage having the opposite polarity to that of the full-color composite toner image on the intermediate transfer belt 30 so that a transfer electric field is formed in the secondary transfer nip.

The full-color composite toner image is transferred from the intermediate transfer belt 30 onto the paper sheet by action of the transfer electric field. Residual toner particles remaining on the intermediate transfer belt 30 without being transferred onto the paper sheet are removed by the belt cleaner 35 and collected in the waste toner storage.

The paper sheet is then conveyed to the fixing device 20 and the full-color composite toner image is fixed on the paper sheet in the fixing device 20. The paper sheet having the fixed full-color composite toner image is discharged onto the discharge tray 14 by rotation of the discharge rollers 13.

In the above-described embodiment, the printer is able to print the color image on the paper sheet. A sheet transfer path forms a C-shape. The printer is able to convey a variety of sheets such as a thick sheet, an envelope, and so on, with a reduced risk of a jam.

Furthermore, the paper sheet is discharged with its printed side facing downward. The paper sheet that is stacked on the discharge tray 14 is stacked in a print order from up to down, when the paper sheets are picked up.

In the above-described embodiment, all of the four process cartridges 4Y, 4M, 4C, and 4K are brought into operation to form full-color images. According to another embodiment, only one of the four process cartridges 4Y, 4M, 4C, and 4K is brought into operation to form single-color images. According to another embodiment, two or three of the four process cartridges 4Y, 4M, 4C, and 4K are brought into operation to form two-color or three-color toner images, respectively.

In the present embodiment, the four process cartridges 4Y, 4M, 4C, and 4K are disposed below the intermediate transfer belt 30 that is rotatable in the direction indicated by the arrow in FIG. 1. In this case, a distance between the primary transfer nip (i.e., the nip formed between the photoreceptor 5 and the primary transfer roller 31) and the secondary transfer nip (i.e., the nip formed between the secondary transfer roller 36 and the secondary transfer backup roller 32) is shorter compared to a case in which the process cartridges are disposed above the intermediate transfer belt 30.

Accordingly, a distance that the intermediate transfer belt 30 travels after the primary transfer is completed before the secondary transfer is executed is shorter, which means that a length of time before the first print is shorter.

The photoreceptors 5 keep rotating in synchronization with the rotation of the intermediate transfer belt 30, to keep supplying toner from the photoreceptors 5 to the intermediate transfer belt 30. The shorter travel distance of the intermediate transfer belt 30 suppresses wear of the photoreceptor or consumption of the toner.

The belt cleaner 35 is provided immediately downstream from the secondary transfer nip, i.e., above the intermediate transfer belt 30, as illustrated in FIG. 1. If the process cartridges 4Y, 4M, 4C, and 4K are provided above the intermediate transfer belt 30, the process cartridges 4Y, 4M, 4C, and 4K and the belt cleaner 35 should be arranged next to each other in a horizontal direction, resulting in an increase in a horizontal width of the image forming apparatus.

By contrast, when the process cartridges 4Y, 4M, 4C, and 4K are provided below the intermediate transfer belt 30 as illustrated in FIG. 1, the process cartridges 4Y, 4M, 4C, and 4K and the belt cleaner 35 need not be arranged next to each other in a horizontal direction, avoiding an increase in the horizontal width of the image forming apparatus.

Figure 2:
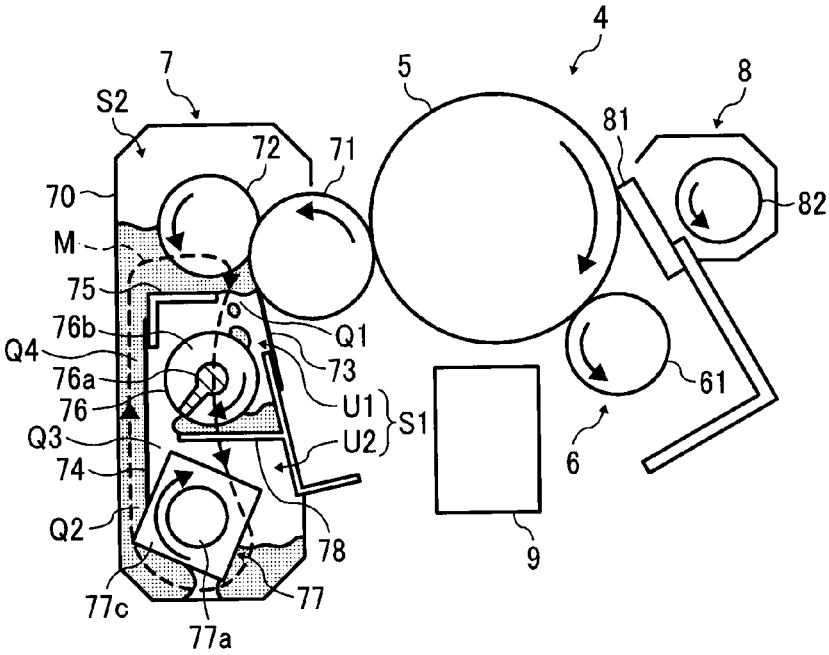
FIG. 2 is a cross-sectional view of a developing device installed in the image forming apparatus illustrated in FIG. 1 perpendicular to an axial direction.

FIG. 2 is a cross sectional view of the process cartridge 4 (hereinafter the additional characters Y, M, C, and K representing the respective colors of yellow, magenta, cyan, and black are omitted for the sake of simplicity). The process cartridge 4 includes the photoreceptor 5, the charger 6, the developing device 7, the cleaner 8, and the irradiator 9.

The charger 6 includes a charging member 61 to charge the photoreceptor 5 by contact therewith and may include a cleaning member to clean the charging member 61. The cleaner 8 includes a cleaning member 81 to remove developer (toner) adhered to a surface of the photoreceptor 5 and a waste toner conveying member 82 to convey waste toner particles removed by the cleaning member 81.

Since a two-component developing system is able to attach the toner to the toner conveyer by magnetic force, it is easier to supply the toner to the toner conveyer than with a one component developing device. However, the two-component developing system leads to an increase in size of the image forming apparatus, and increased expense. The one component developing system has an advantage of producing a small and low-priced image forming apparatus.

However, the one component developing system has an impasse where the toner accumulates therein, at an upper of the developing device 7. The impasse has a developing section which includes a developing roller 71, a supply roller 72, and a regulating blade 73. When the process cartridges 4Y, 4M, 4C, and 4K are provided below the intermediate transfer belt 30 as illustrated in FIG. 1, toner is pumped up and supplied to developing section of the impasse by a rotating fin.

As shown in FIG. 2, the developing device 7 includes a housing 70, the developing roller 71 serving as a developer carrier to carry toner, the supply roller 72 serving as a supply member to supply toner to the developing roller 71, and the regulating blade 73 serving as a regulator to regulate a thickness of toner carried on the developing roller 71.

The developing device 7 includes a conveying screw 76 serving as a first developer conveyer (first powder conveyer, first rotating member) to convey the toner, and a pumping member 77 serving as second developer conveyer (second powder conveyer, second rotating member).

The developer carrier is not limited to the developing roller 71 and may be a developing belt. The regulator is not limited to the regulating blade 73 and may be a regulating roller.

The space inside the housing 70 includes a first divider 74 and a holding member 75 which holds the first divider 74. The space is divided by the first divider 74 and holding member 75 to form a mixing chamber S1 serving as a first developer storing chamber and a supply chamber S2 serving as a second developer storing chamber. The supply chamber S2 is disposed above the mixing chamber S1.

Referring to FIG. 2, the mixing chamber S1 includes the conveying screw 76 and the pumping member 77. The supply chamber S2 includes the supply roller 72. The supply chamber S2 and the mixing chamber S1 are communicated with each other via an upper communicating path Q1, a lower communicating path Q2, and a pumping path Q4. The lower communicating path Q2 is disposed at a lower end of the pumping path Q4 extending in a vertical direction.

The mixing chamber S1 is divided to form a first mixing space U1 and a second mixing space U2. The first mixing space U1 includes the conveying screw 76, and is disposed above the second mixing space U2. The first mixing space U1 and the second mixing space U2 are divided by a second divider 78 that is disposed in the housing 70 integrally.

The supply roller 72, the conveying screw 76, and the pumping member 77 are arranged in a row. Thereby, the developing device 7 is able to be thin in a left and right direction in FIG. 2. This makes a distance between the photoreceptors 5 short.

Figure 3:
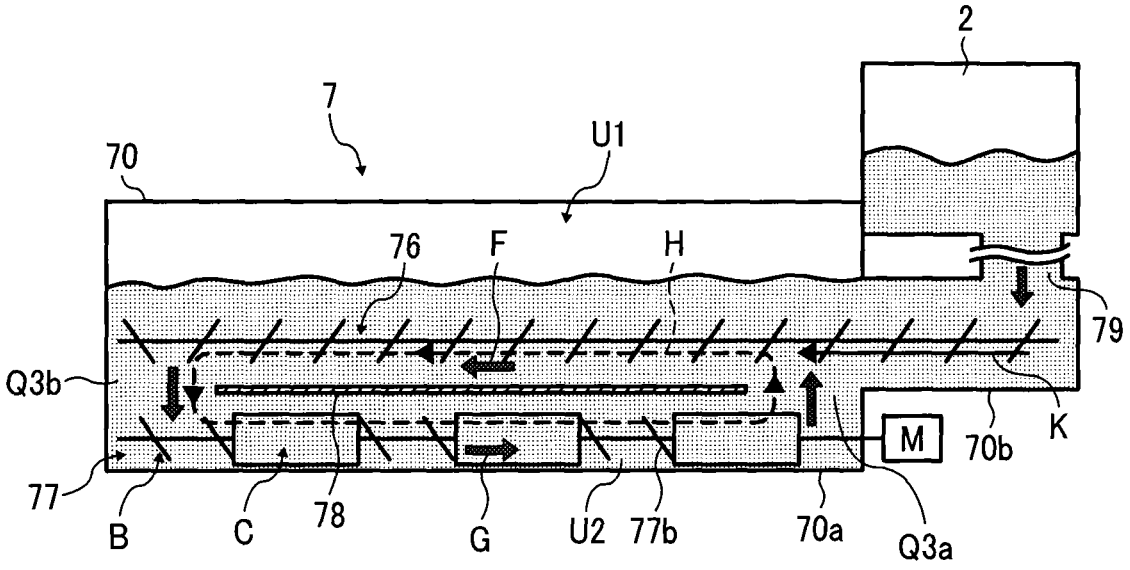
FIG. 3 is a schematic view showing how a drawing member draws toner in the developing device.

The second divider 78 extends in a longitudinal direction of the conveying screw 76 and the pumping member 77 (a direction orthogonal to a paper surface of FIG. 2.). A communicating path Q3 (a first communicating path Q3*a* and a second communicating path Q3*b* are shown in FIG. 3) which is able to communicate with the first mixing chamber U1 and the second mixing chamber U2, is disposed at a longitudinal direction end part side of the second divider 78.

The first divider 74 is comprised of a flexible thin plate made of, for example, a metal or a resin. The first divider 74 is disposed in parallel with the developing roller 71 and the supply roller 72 in an axial direction and has the same axial dimension as the developing roller 71 and the supply roller 72.

An upper end of the first divider 74 is fixed to the holding member 75 and disposed close to the supply roller 72 (i.e., immediately below the supply roller 72 in FIG. 2). A lower end portion of the first divider 74 extends obliquely downward from the fixed point. The lower end portion of the first divider 74 is a free end. The lower end portion of the first divider 74 contacts with the pumping member 77 over a whole region of a shaft from an upper side.

The pumping path Q4 extending in the vertical direction is disposed between the first divider 74 and a vertical wall of the housing 70. A lower end portion (an end of an upstream side) of the pumping path Q4 connects to a second conveying part C of the pumping member 77 as the second rotating member. An upper end portion (an end of a downstream side) of the pumping path Q4 connects to the supply chamber S2 as the second developer storing chamber.

The conveying screw includes a rotating shaft 76*a* parallel to the developing roller 71 and the supply roller 72, and a spiral vane 76*b* disposed at a surface of the rotating shaft 76*a*. The conveying screw 76 conveys the toner to one side in an axis direction of the rotating shaft 76*a* by rotating via a drive means.

In this specification, the conveying screw 76 is disposed at a restriction region of the regulating blade 73. In other words, the conveying screw 76 is disposed at a vertical lower portion of a contact point between the developer carried by developing roller 71 and the regulating blade 73. The conveying screw 76 is formed longer than the pumping member 77 in the axis direction.

The pumping member 77 includes a rotating shaft 77*a* parallel to the rotating axis of the developing roller 71 and supply roller 72, a first conveying part B to convey the toner to the other side of the axis direction of the rotating shaft by pushing, and the second conveying part C to convey the toner in a rotating direction of the rotating shaft 77*a*.

Referring to FIG. 3, the first mixing chamber U1 and the second mixing chamber U2 are communicating with each other through the first communicating path Q3*a* and the second communicating path Q3*b*, which are disposed in a longitudinal direction at both sides of end parts of the second divider 78. The upstream end part of the first mixing chamber U1 and the downstream end part of the second mixing chamber U2 are connected by the first communicating path Q3*a*. The downstream end part of the first chamber U1 and the upstream end part of the second mixing chamber U2 are connected by the second communicating path Q3*b*.

Referring to FIG. 3, the length in the axis direction of the conveying screw 76 is longer than that of the pumping member 77. The first mixing chamber U1 including the conveying screw 76 is longer than the second mixing chamber U2 including the pumping member 77.

The housing 70 includes a main body part 70*a* storing the pumping member 77 and the developing roller 71, and a projecting portion 70*b* projected from the main body part 70*a* in the axis direction, and covering one end side portion of the conveying screw (the right side in FIG. 3).

An upper portion of the projecting portion 70*b* has a tonner supplying opening 79 to supply the one-component toner from the toner cartridges 2 to the developing device 7. The toner supplying opening 79 has a shutter serving as an opening/closing member.

Usually the toner supplying opening 79 is closed, however when an amount of the toner detected by a toner detector 90 becomes below a reference value, the opening/closing member moves to open the toner supplying opening 79. Thereby, new toner is supplied to the first mixing chamber U1 from the toner cartridges 2 via the toner supplying opening 79.

Since the first communicating path Q3*a* is disposed immediately downstream of the toner supplying opening 79, a mixing time for mixing old toner with new toner is able to gain time from the first communication path Q3 as a start position to a developing area. Thereby, the new toner and old toner is mixed well, and the image forming apparatus can obtain a stable output of images free of density variation and ground staining. The toner supplying opening 79 can be provided at the second mixing chamber U2. In this case, the projecting portion 70*b* is not disposed at the housing 70, the conveying screw 76, the pumping member 77 and developing roller 71 are a same length in the axis direction, and the conveying screw 76 and the pumping member 77 are stored in the main body part 70*a*.

When the conveying screw 76 rotates, the toner is conveyed in a direction of an arrow F in FIG. 3. On the other hand, when the pumping member 77 rotates, the toner is conveyed in a direction of an arrow G direction in FIG. 3 by vanes 77*b* disposed on the first conveying part B. The conveying screw 76 and the pumping member 77 convey the toner in opposite directions.

The toner conveyed by the conveying screw 76 and the pumping member 77 is pressed to an inside of the housing 70 at each downstream of conveying direction. The toner is conveyed from the first mixing chamber U1 to the second mixing chamber U2, or from the second mixing chamber U2 to the first mixing chamber U1 via the first and second communicating paths Q3*a*, Q3*b*.

In this way, the toner is conveyed in the opposite directions by the conveying screw 76 and the pumping member 77. The toner is thus conveyed along a circulation path H indicated by a broken line in FIG. 3.

Figure 4A:
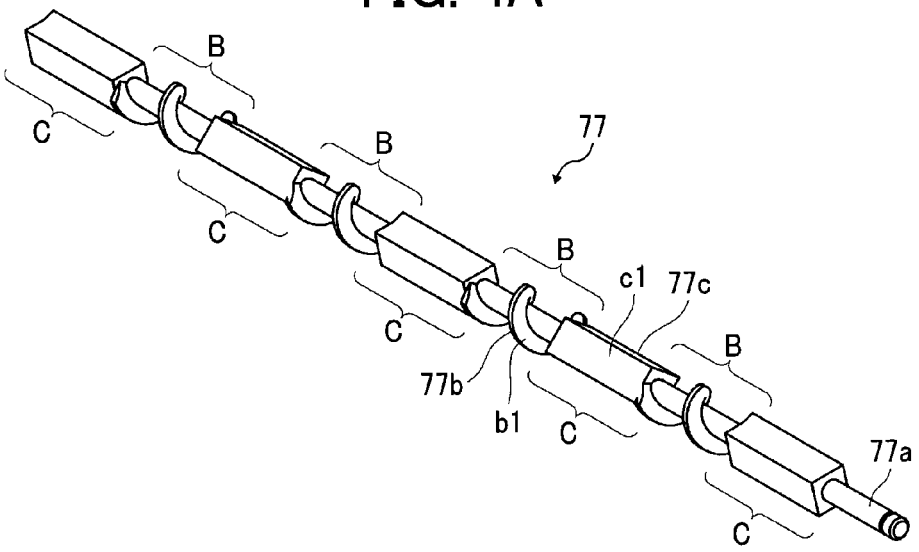
FIGS. 4(*a*) to 4(*c*) are schematic views of a pumping member.
Figure 4B:
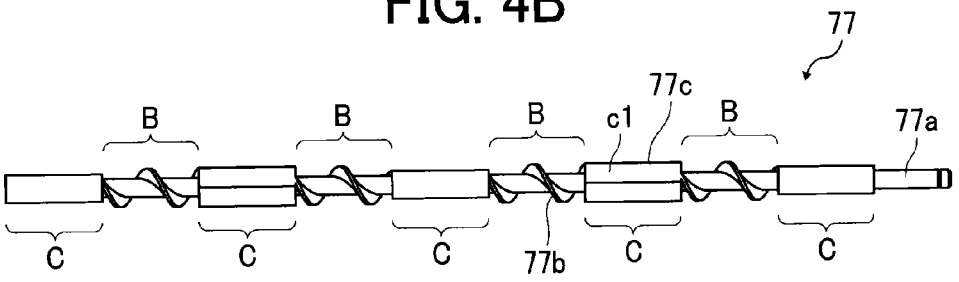
Figure 4C:
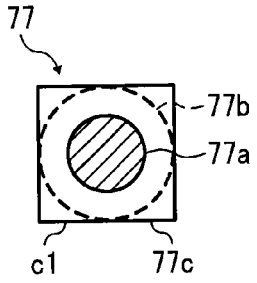

When the new toner is supplied from the toner cartridge 2 to the first mixing chamber U1 via the toner supplying opening 79, the new toner is conveyed along a conveying path K shown in FIG. 3 by the conveying screw 76. The new toner is joined with not-new toner (old toner) conveyed along the circulation path H at a side downstream of the conveying direction A detail of the pumping member 77 is described in FIGS. 4(*a*) to 4(*c*). FIG. 4(*a*) is a perspective view of the pumping member 77; FIG. 4(*b*) is a side view; and FIG. 4(*c*) is a cross section view.

Referring to FIGS. 4(*a*) to 4(*c*), the pumping member 77 has the first conveying part B and the second conveying part C alternately along a direction of the axis of the rotating shaft 77*a*.

The first conveying part B has the spiral vane 77*b* serving as a conveying surface b1 inclined with respect to the rotating shaft 77*a*. The spiral vane 77*b* is arranged at a length of the axial direction of the rotating shaft 77*a*.

The spiral vane 77*b* is a one spiral blade. However, the spiral vane 77*b* can be two or more spiral blades. Instead of the spiral vane 77*b*, one or more paddles inclined with the rotating shaft 77*a* can be disposed on the rotating shaft 77*a*.

The second conveying part C has a polygonal rod 77*c* extending along the direction of axis of the shaft. The second conveying part C is a right quadrangular prism in the FIG. 4. However, the polygonal rod 77*c* can be a triangular prism, other polygonal shape, or an elliptic shape rod.

Figure 8A:
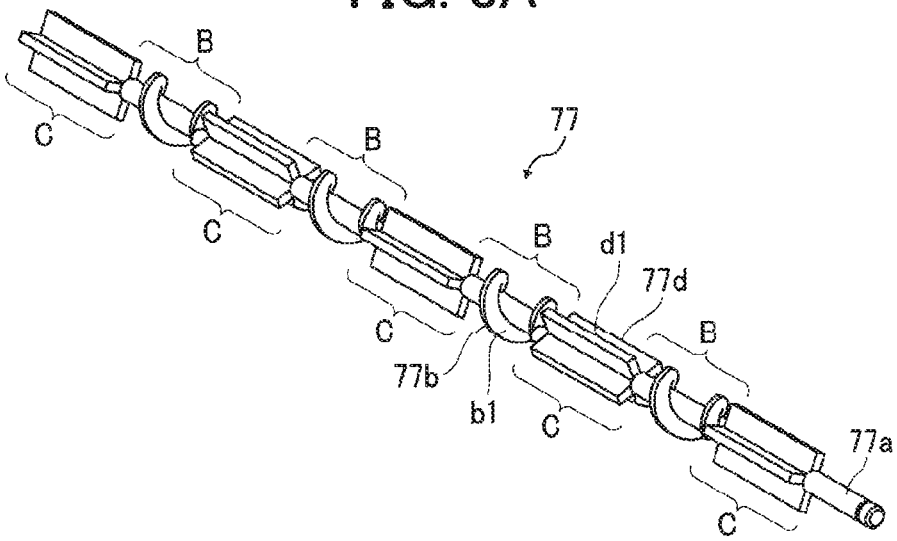
FIGS. 8(*a*) to 8(*c*) are views of the pumping member according to another embodiment.
Figure 8B:
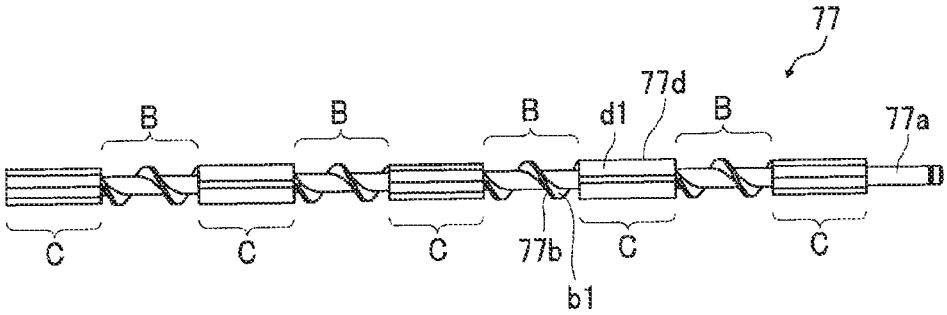
Figure 8C:
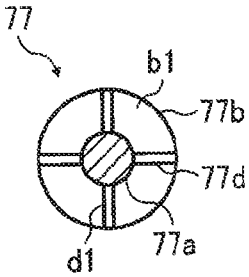

The second conveying part C can be a plate shape member 77*d* as shown in FIGS. 8(*a*) to 8(*c*). The second conveying part C including the polygonal rod 77*c* has a conveying surface c1 parallel with the rotating shaft 77*a* along the direction of the axis of the shaft. In FIG. 4, four surfaces of the polygonal rod 77*c* include a rectangular conveying surface c1 at intervals of 90 degrees.

An edge of the spiral vane 77*b* is not protruding from the conveying surface c1 when viewed from the axis direction. On the other hand, even if the edge of the spiral vane 77*b* is protruding from the conveying surface c1, it is better for the edge not to protrude greatly. In this case, the conveying surface c1 keeps a pumping effect.

Figure 5:
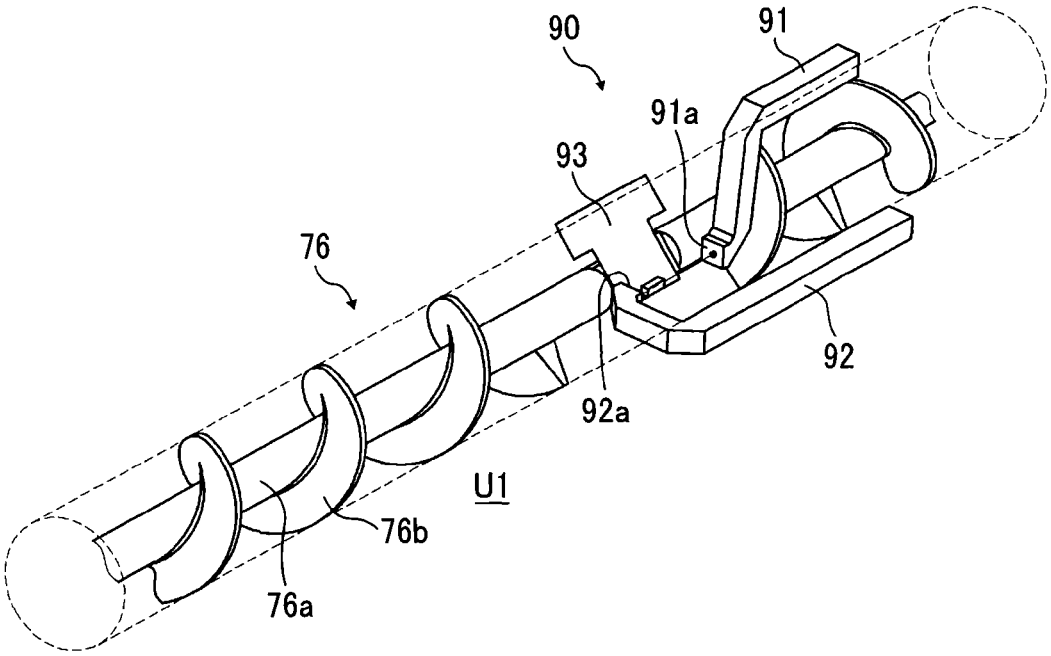
FIG. 5 is a schematic view of a toner detector.

The mixing chamber S1 has a toner detector 90 serving as a developer detector to detect the amount of toner stored in the mixing chamber S1. Referring to FIG. 5, the toner detector 90 includes a first light guiding member 91 and a second light guiding member 92 both fixed to the housing 70, and a cleaning member 93 fixed to a conveyance member (i.e., the conveying screw 76 in the present embodiment).

One end of the first light guiding member 91 is connected to a light-emitting element and the other end functions as a light-emitting surface 91*a*. One end of the second light guiding member 92 is connected to a light-receiving element and the other end functions as a light-receiving surface 92*a*. The light-emitting surface 91*a* of the first light guiding member 91 and the light-receiving surface 92*a* of the second light guiding member 92 are facing each other in an axial direction.

The cleaning member 93 is comprised of a flexible plate member made of, for example, a PET sheet. The cleaning member 93 rotates along with the conveying screw 76. As the cleaning member 93 rotates, the cleaning member 93 slidably contacts the light-emitting surface 91*a* of the first light guiding member 91 and the light-receiving surface 92*a* of the second light guiding member 92 to remove toner particles adhered to the light-emitting surface 91*a* and the light-receiving surface 92*a*. Moreover, as the cleaning member 93 rotates, toner particles accumulated at a lower part of the mixing chamber S1 are scraped up by the cleaning member 93 and allowed to pass through between the light-emitting surface 91*a* and the light-receiving surface 92*a*.

While the scraped-up toner particles are passing through between the light-emitting surface 91*a* and the light-receiving surface 92*a*, light emitted from the light-emitting surface 91*a* cannot reach the light-receiving surface 92*a* and the light-receiving element detects no signal. During the rest of the time, light emitted from the light-emitting surface 91*a* reaches the light-receiving surface 92*a* and the light-receiving element detects a signal.

Since an amount of toner scraped up by the cleaning member 93 varies depending on an amount of toner in the mixing chamber S1, the light-receiving time of the light-receiving element also varies. Accordingly, by detecting the light-receiving time of the light-receiving element, the amount of toner in the mixing chamber S1 can be detected.

Figure 6A:
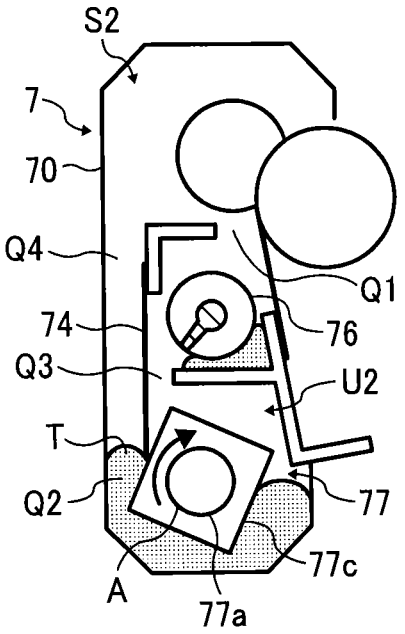
FIGS. 6(*a*) to 6(*c*) describe steps in which the toner is pumped by the pumping member.
Figure 6B:
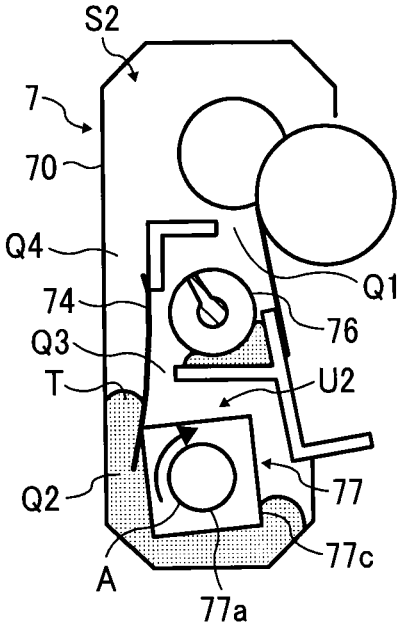
Figure 6C:
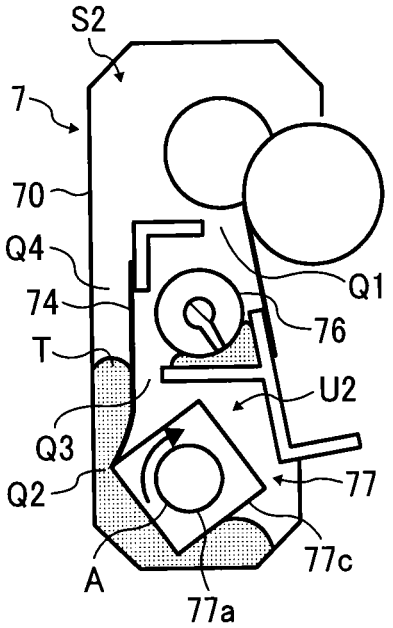

A toner conveying operation is explained as follows. First, toner pumping operation by the pumping member 77 is explained based on FIGS. 6(*a*) to 6(*c*). FIGS. 6(*a*) to 6(*c*) describe steps in which the toner is pumped by the pumping member.

When the pumping member 77 is rotated in a direction of an arrow A by the drive means M shown in FIG. 3, the conveying surface c1 of the second conveying part C which is formed like polygonal rod, an inner surface of the housing 70, and the first divider 74 work together. In this case, the toner T in the second mixing chamber U2 is pumped upwardly. Then the toner is pushed into the supply chamber S2 via the lower communicating path Q2 (See, FIGS. 6(*a*) to 6(*c*)).

As the pumping member 77 rotates, the toner held on the conveying surface c1 of the polygonal second conveying part C is struck by a lower end of the first divider 74, and is pumped. The toner in the second mixing chamber U2 is supplied to the supply chamber S2 by repeating same action. The lower end of the first divider 74 works like a check valve. The pumping member 77 may rotate continuously or only rotate when a rotate command is made.

The lower end portion of the first divider 74 is pushed to the pumping member 77 with a carving shape while the pumping member 77 is rotating. If the pumping member 77 rotates, the first divider 74 contacts with the pumping member 77 constantly.

The toner T pumped by the pumping member 77 is prevented from returning to the second mixing chamber U2 through the gap between the first divider 74 and the pumping member 77. By rotating the pumping member 77 all the time, the toner is pushed from the lower end of the second mixing chamber U2. Thus, the toner is prevented from running back to the second mixing chamber U2.

At the lower end part of the first divider 74 there may be formed a plurality cuts in a vertical direction to surely strike. An interval of these cuts may correspond to the length of the polygonal rod 77*c* in the axis direction. To form the cuts, the lower portion of the first divider 74 may have independent parts between the cuts, and the independent parts each strike an outer surface of a respective one of the polygonal rods 77*c*.

If the edge of the spiral vane 77*b* protrudes from a surface of the polygonal rod 77*c* to improve a conveying power, it is better that the cuts are formed at the lower end part of the first divider 74 to keep the conveying power of the first conveying part B and the second conveying part C. The lower end of the first divider 74 may contact the first conveying part B and second conveying part C while the pumping member 77 is rotating.

The toner conveying operation is explained referring to FIG. 2. When a developing operation starts, the photoreceptor 5, the developing roller 7, and the supply roller 72 each rotate in a direction of the arrows.

Then, the conveying screw 76 and the pumping member 77 start rotating. The toner in the second mixing chamber U2 is pumped by the rotation of the pumping member 77 to the supply chamber S2 via the pumping path Q4 and the toner is stored in the supply chamber S2.

When an upper surface of the toner T reaches the supply roller 72, the toner is transferred to the developing roller 71 via the supply roller 72. Since the supply chamber S2 does not have a screw as a conveyer, the upper surface of the toner keeps horizontal to a direction of the axis, and the toner is supplied to an area of developing roller 71 in the direction of the axis.

A surface of the first divider 74, and an inner surface of the housing 70 which is opposed to a surface of the first divider 74 forming an inner wall of the supply chamber S2, are smooth surfaces without concavities or convexities. Thus, retaining the toner at the inner wall of the supply chamber S2 is prevented.

Surplus toner among the toner caught by the developing roller 71 is regulated by the regulating blade 73, and the regulated surplus toner falls down to the conveying screw 76 disposed under the regulating area.

When the opening/closing member of the toner supplying opening 79 opens, the new toner is supplied to the conveying screw 76 from a toner cartridge. The toner is circulated in the mixing chamber S1 by the conveying screw 76 and the pumping member 77, and the new toner and old toner are mixed. The toner mixed in the mixing chamber S1 is supplied to the supply chamber S2 by the pumping member 77. In the developing device 7, the toner regulated by the regulating blade 73 falls down to the first mixing chamber U1. Referring to FIG. 2, a circulation path M (a first circulation path) of the toner is thus formed. In one example, this circulation path is connected as follows: the first mixing chamber U1—the communicating path Q3 (a second communicating path)—the second mixing chamber U2—the communicating path Q2—the pumping path Q4—the supply chamber S2—the supplying roller 72—the developing roller 71—the communicating path Q1—the first mixing chamber U1. Circulating the toner in the developing device 7 prevents the deterioration of the toner.

Referring to FIG. 3, in the mixing chamber S1, the toner is conveyed along a circulation path H (a second circulation path) by the conveying screw 76 and the pumping member 77. The conveying screw 76 and the pumping member 77 convey the toner in the opposite directions. The toner is mixed in the mixing chamber S1.

Supplying the toner to a middle of the circulation path H from the toner supplying opening 79, the new toner and the old toner are mixed enough. Supplying the mixed toner to the supply chamber S2, the old toner is prevented from being distributed unevenly to the developing roller 71. A thin spot on the image occurring by unevenly distributed toner is thus prevented.

The pumping member 77 includes the first conveying part B conveying the toner in the direction of the axis, and the second conveying part C conveying the toner in the rotating direction of the axis. In this case, one conveyer (the pumping member 77) can convey the toner in each of directions to mix the toner in the mixing chamber S1, and to pump the toner to the supply chamber S2. Therefore, it is not necessary to install two or more conveyers for different conveying directions. This is particularly useful to make the developing device 7 small, and to convey the toner efficiently to the directions along the two circulation paths H, M.

By the way, if there is a gap between the first divider 74 and the pumping member 77, the toner pumped by pumping member 77 is not supplied to the second supply chamber S2 and runs back to the second mixing chamber U2 via the gap. As a result, the toner supply efficiency decreases.

Therefore, as mentioned above, the first divider 74 contacts constantly to the pumping member 77 by elastically deforming. This configuration avoids forming the gap between the first divider 74 and the pumping member 77. Thus, the toner is supplied more efficiently.

Moreover, since the first divider 74 contacts the pumping member 77 by elastically deforming, a small vibration occurs according to the rotating of the pumping member 77. The toner conveyed by the first conveying part B and second conveying part C is thus loosened up and prevented from condensing by the vibration.

Preferably, a toner carrying capacity of the pumping member 77 to the supply chamber S2 is greater than a toner carrying capacity of the conveying screw 76 to the second mixing chamber U2. The capacity of the conveying screw 76 and the pumping member 77 are easily adjusted by changing a rotating speed or a size of the conveying screw 76 and the pumping member 77. By adjusting the toner conveying capacity, enough of the toner is present near the developing roller 71 to prevent deterioration in development.

Moreover, preferably, the toner carrying capacity of the pumping member 77 to the mixing chamber U1 is greater than the toner carrying capacity of the conveying screw 76 to the second mixing chamber U2. By this configuration, the toner retaining at a bottom part of the second mixing chamber U2 is mixed efficiently.

As described above, disposing the conveying screw 76 under the regulating area of the regulating blade 73, the old toner divided from the developing roller 71 at this area may fall to above the rotating conveying screw 76.

Supplying the new toner to the conveying path with the conveying screw 76 from the toner supplying opening 79 starts to mix the old toner and the new toner. Since the first communicating path Q3 is disposed downstream of the toner supplying opening 79, mixing of the old toner divided at the regulating area and the new toner is started from the first communicating path Q3.

Therefore, a mixing time before a developing time and a toner moving distance are able to be long. Thus, the toner is homogenized. Thereby, the new toner and old toner are mixed well, and the image forming apparatus can obtain a stable output of images free of density variation and ground staining.

Figure 7:
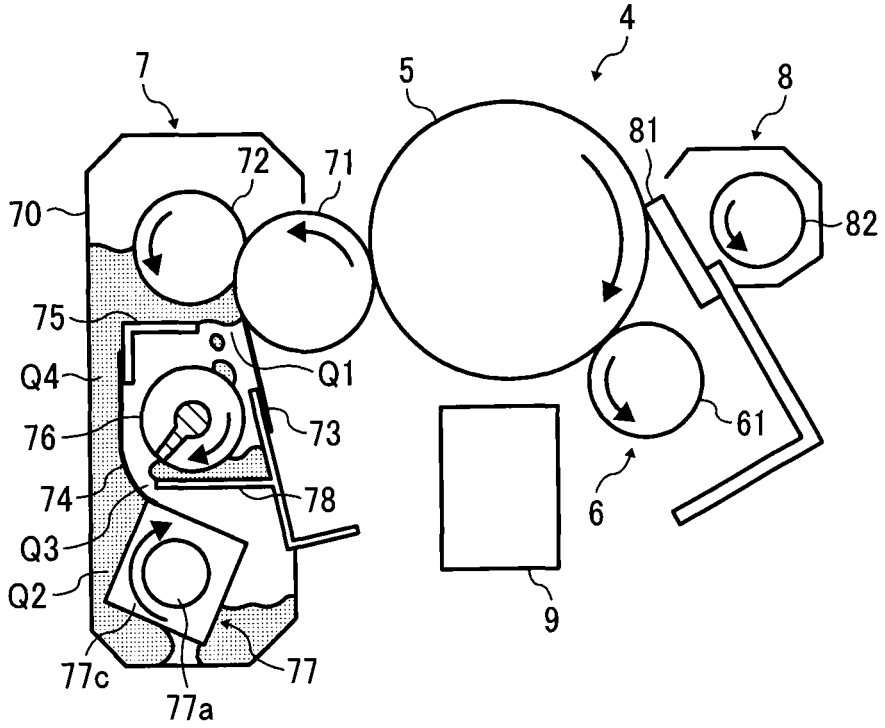
FIG. 7 is a view of a first divider contacting the pumping member to a trailing direction illustrated in FIG. 2.

In the above embodiment, a contact direction of the first divider 74 to the pumping member 77 is a counter direction (an edge of the first divider 74 faces an opposite direction of the rotating direction of the pumping member 77). However, for example, as illustrated in FIG. 7, it is possible to be a trailing direction (the edge of the first divider 74 faces a same direction as the rotating direction of the pumping member 77). In this case, when the contact direction of the first divider 74 is in the trailing direction, a turning up of the first divider 74 by rotating the pumping member 77 can be prevented.

Another embodiment of the pumping member 77 is described in FIGS. 8(*a*) to 8(*c*). FIG. 8(*a*) is a perspective view of the pumping member 77; FIG. 8(*b*) is a side view; and FIG. 8(*c*) is a cross section view.

This embodiment is about the second conveying part C that includes a plurality of plate-like members 77*d* protruding from the rotating axis 77*a* in a radial direction. Other components are the same as components in FIG. 4.

The first conveying part B and the second conveying part C are disposed alternately along the direction of the axis of the rotating axis 77*a*.

A surface of each of the plate-like members 77*d* facing the rotating direction is a conveying surface dl that has a prescribed length along a direction parallel to the rotating axis 77*a*. On the other hand, the first conveying part B has a spiral vane 77*b* disposed along the axis direction. The plate-like members 77*d* are formed to a total of 4, every 90 degrees, around the rotating axis 77*a*. However, it is possible to change the spacing degree and amount of plate-like members.

An edge of the spiral vane 77*b* is not protruding from the edge of the plate-like members 77*d* when viewed from the axis direction. On the other hand, even if the edge of the spiral vane 77*b* does protrude from the edge of the plate-like members 77*d*, it is better for the edge not to protrude greatly. In this case, the plate-like members 77*d* keep the pumping effect.

Figure 9:
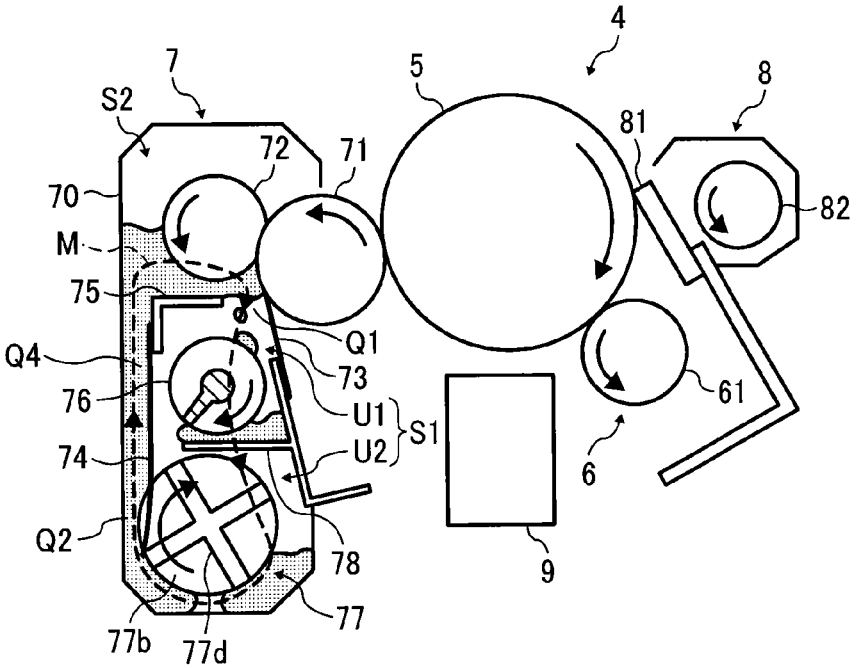
FIG. 9 is a cross sectional view of a process unit including the pumping member according to another embodiment.
Figure 10:
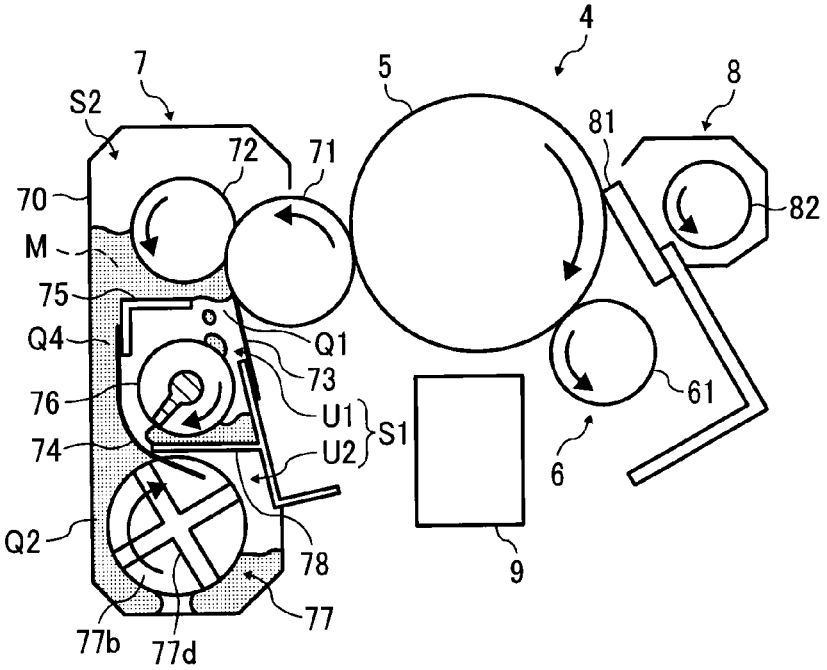
FIG. 10 is a view of the first divider contacting the pumping member to the trailing direction illustrated in FIG. 9.

When the pumping member 77 is rotated as described in FIGS. 9 and 10, the toner is pushed to the rotating direction. The inner surface of the housing 70 and the first divider 74 work together. In this case, the toner T in the second mixing chamber U2 is pumped upwardly, and then the toner is pushed into the supply chamber S2 via the lower communicating path Q2. At that time, the toner is conveyed to the axis direction by each of the spiral vanes 77*b* of the first conveying part B.

The embodiment described in FIGS. 8 to 10 can convey the toner in two different directions at a same time by one conveyer (the pumping member 77). One of the two different directions is a conveying direction for mixing the toner in the mixing chamber S1 described in FIG. 3. Another one of the two different directions is a conveying direction for pumping the toner to the supply chamber S2 described in FIG. 9.

In this embodiment, the plate-like members 77*d* serving as the second conveying part C form a paddle. Thus, an amount of toner held by the second conveying part C increases. Therefore, the amount of toner struck by the first divider 74 with rotation of the pumping member 77 increases, and the capacity of pumping can be increased.

Figure 11:
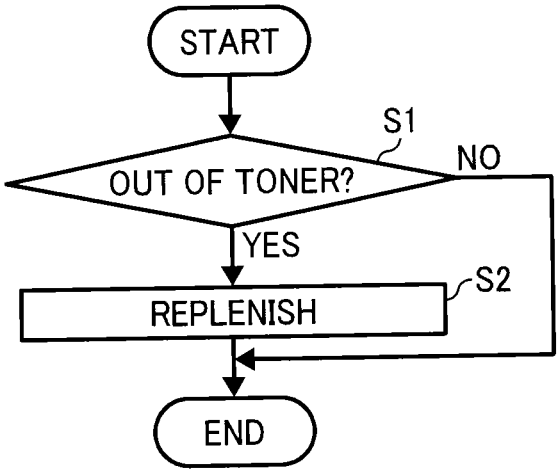
FIG. 11 illustrates a flow chart of a toner supply process according to an embodiment of the present invention.

As shown in FIG. 11, the developing device handles a toner supply process. In a step S1, when a result of a detection by a toner detector is that the developing device is out of toner (step S1 being yes), the process moves to a step S2. In the step S2, the toner is replenished by new toner being supplied to the developing device via a toner supplying opening.

In one non-limiting illustrative embodiment, control steps in this toner supply process, or in any other processes described in this patent specification, may be executed utilizing hardware, software, or any combination thereof. In a non-limiting illustrative example, a controller, or its equivalents, such as a processor/microprocessor, a central processing unit (CPU), at least one application specific processor (ASP), or other circuitry, may implement such control steps, and may utilize a computer readable storage medium (e.g., ROM, EPROM, EEPROM, flash memory, static memory, DRAM, SDRAM, and their equivalents).

The disclosure of this patent specification is not intended to be limited to the specific terminology so selected, and it is to be understood that each specific element includes all technical equivalents that operate in a similar manner and achieve a similar result.

An image forming apparatus for installing the developing device according to an embodiment of the invention is not limited to the printer illustrated in FIG. 1 and may be any of a copier, a facsimile machine, and a combined machine thereof.

The conveyer (the pumping member 77) can be used for a powder conveying device different from the developing device. For example, the conveyer may be used for a waste toner container that contains the waste toner collected by the cleaning device of the photoreceptor or a middle transfer belt. Therefore, the waste toner is conveyed in two directions (the axis direction and the rotating direction), so that the waste toner is contained effectively.

What is claimed is:

1. A developing device comprising:

a housing to store a powder;

a developing roller to hold the powder;

a supplying roller to supply the powder to the developing roller;

a regulator to regulate the powder held by the developing roller;

a powder conveyer to convey the powder for image forming, the powder conveyer including a first conveying part that includes a rotating axis, and a conveying surface inclined with respect to the rotating axis along a direction of the rotating axis; and a second conveying part that includes a conveying surface parallel to the rotating axis along the direction of the rotating axis, and the first conveying part and the second conveying part are disposed alternately along the direction of the rotating axis;

a first powder storing chamber to store the powder separated from the developing roller; and a second powder storing chamber disposed above the first powder storing chamber to store the powder to be supplied to the developing roller by the supplying roller, wherein the first powder storing chamber is divided into a first mixing chamber and a second mixing chamber, the first mixing chamber includes a first rotating member to convey the powder in a first direction, the second mixing chamber includes the powder conveyer to convey the powder in a second direction different than the first direction, the developing device is a one-component developing system to develop, an upstream end part of the first mixing chamber in the first direction and a downstream end part of the second mixing chamber in the second direction are in communication by a first communicating path, a downstream end part of the first mixing chamber in the first direction and an upstream end part of the second mixing chamber in the second direction are in communication by a second communicating path, and a toner supplying opening to supply the powder is connected to the first communicating path.

2. The developing device according to claim 1, wherein the first conveying part is a spiral vane, and the second conveying part is a polygonal part extended along the rotating axis.

3. The developing device according to claim 1, wherein the first conveying part is a spiral vane, and the second conveying part is a plate-like member protruding from the rotating axis in a radial direction.

4. The developing device according to claim 1, further comprising:

a driver to drive the powder conveyer.

5. The developing device according to claim 1, wherein a carrying capacity of the powder conveyer in an axis direction is greater than a carrying capacity of the first rotating member in the axis direction.

6. The developing device according to claim 1, wherein the first rotating member is disposed below a regulating area of the regulator in a vertical direction.

7. The developing device according to claim 1, further comprising:

a toner detector to detect an amount of the powder, wherein a control amount of the powder supplied from the toner supplying opening is based on a detection result of the toner detector.

8. A process unit comprising:

a photoreceptor; and the developing device according to claim 1.

9. An image forming apparatus comprising:

the developing device according to claim 1.

10. A developing device, comprising:

a housing to store a powder;

a developing roller to hold the powder;

a supplying roller to supply the powder to the developing roller;

a regulator to regulate the powder held by the developing roller;

a powder conveyer to convey the powder for image forming, the powder conveyer including a first conveying part that includes a rotating axis, and a conveying surface inclined with respect to the rotating axis along a direction of the rotating axis; and a second conveying part that includes a conveying surface parallel to the rotating axis along the direction of the rotating axis, and the first conveying part and the second conveying part are disposed alternately along the direction of the rotating axis;

a first powder storing chamber to store the powder separated from the developing roller, and the first powder storing chamber is divided into a first mixing chamber and a second mixing chamber;

a second powder storing chamber disposed above the first powder storing chamber to store the powder to be supplied to the developing roller by the supplying roller;

a first divider to divide the first powder storing chamber and second powder storing chamber, and the first divider is a part of a pumping path; and a second divider to divide the first mixing chamber and the second mixing chamber of the first powder storing chamber, wherein the first mixing chamber includes a first rotating member to convey the powder in a first direction, the second mixing chamber includes the powder conveyer to convey the powder in a second direction different than the first direction, the second mixing chamber and the second powder storing chamber are connected via the pumping path, an upstream end part of the pumping path in a conveyance direction of the powder connects with the second conveying part of the powder conveyer, a downstream end part of the pumping path in the conveyance direction of the powder connects with the second powder storing chamber, and the first divider contacts with the powder conveyer in the direction of the rotating axis and elastically deforms with contact from the powder conveyer when the powder conveyer rotates.

11. The developing device according to claim 10, further comprising:

a first communicating path between an upstream end part of the first mixing chamber in the first direction and a downstream end part of the second mixing chamber in the second direction;

a second communicating path between a downstream end part of the first mixing chamber in the first direction and an upstream end part of the second mixing chamber in the second direction, and the first communicating path and the second communicating path are provided in a longitudinal direction at both sides of end parts of the second divider.

12. A developing device comprising:

a housing to store a powder;

a developing roller to hold the powder;

a supplying roller to supply the powder to the developing roller;

a regulator to regulate the powder held by the developing roller;

a powder conveyer to convey the powder for image forming, the powder conveyer including a first conveying structure that includes a rotating shaft, and a conveying surface inclined with respect to the rotating shaft along a direction of the rotating shaft; and a second conveying structure that includes a conveying surface parallel to the rotating shaft along the direction of the rotating shaft, and the first conveying structure and the second conveying structure are disposed alternately along the direction of the rotating axis;

a first powder storing chamber to store the powder separated from the developing roller; and a second powder storing chamber disposed above the first powder storing chamber to store the powder to be supplied to the developing roller by the supplying roller, wherein the first powder storing chamber is divided into a first mixing chamber and a second mixing chamber, the first mixing chamber includes a first rotating structure to convey the powder in a first direction, the second mixing chamber includes the powder conveyer to convey the powder in a second direction different than the first direction, the developing device is a one-component developing system to develop, an upstream end part of the first mixing chamber in the first direction and a downstream end part of the second mixing chamber in the second direction are in communication by a first communicating path, a downstream end part of the first mixing chamber in the first direction and an upstream end part of the second mixing chamber in the second direction are in communication by a second communicating path, and a toner supplying opening to supply the powder is connected to the first communicating path.

* * * * *